United States Patent [19]

Spence

[11] 4,317,772

[45] Mar. 2, 1982

[54] PROCESS FOR PREPARATION OF AMINATED SULFURIZED OLEFINS USING ALKALINE EARTH METAL COMPOUNDS

[75] Inventor: J. Ronald Spence, Bartlesville, Okla.

[73] Assignee: Standard Oil Company (Indiana), Chicago, Ill.

[21] Appl. No.: 196,041

[22] Filed: Oct. 10, 1980

[51] Int. Cl.[3] ..... C07G 17/00

[52] U.S. Cl. ..... 260/132; 252/46.4; 252/47; 252/47.5; 260/125; 260/139

[58] Field of Search ..... 252/46.4, 47, 47.5; 260/132, 125, 139

[56] References Cited

U.S. PATENT DOCUMENTS

| | | | |
|---|---|---|---|
| 2,467,713 | 4/1949 | Watkins | 252/47 X |
| 2,924,572 | 2/1960 | Lawrene et al. | 252/47 |
| 3,364,232 | 1/1968 | Anderson | 252/45 X |
| 3,459,664 | 8/1969 | Anderson | 252/47 |
| 3,471,404 | 10/1969 | Myers | 252/45 |
| 3,600,327 | 8/1971 | Hu | 252/47 X |
| 4,119,549 | 10/1978 | Davis | 252/47 X |
| 4,119,550 | 10/1978 | Davis | 252/464 X |

*Primary Examiner*—Andrew Metz

*Attorney, Agent, or Firm*—Mark DiPietro; William T. McClain; William H. Magidson

[57] ABSTRACT

Processes for the production of aminated sulfurized olefins are improved by performing the reaction in the presence of a tar and charred reaction byproduct reducing amount of an alkali metal or alkaline earth metal compound.

5 Claims, No Drawings

PROCESS FOR PREPARATION OF AMINATED SULFURIZED OLEFINS USING ALKALINE EARTH METAL COMPOUNDS

This invention relates to lubricating oil and lubricating oil additives. More particularly, this invention relates to a process for the preparation of aminated-sulfurized olefins used as dispersants in lubricating oils. Aminated-sulfurized olefins, also called aminated trithiones and their use as lubricant dispersants are taught in U.S. Pat. Nos. 3,459,664 and 3,364,232.

Processes for the preparation of the aminated sulfurized olefins are often performed at high temperatures to promote both the sulfurization and the amination reactions. The high temperature energetic reactions produce large amounts of sticky-tarry reactant degradation byproduct which prevents efficient purification. The tarry byproduct plugs filters and resists centrifugation. The tarry degradation byproduct coats processing equipment preventing effective processing and can contaminate lubricating oils containing the aminated sulfurized olefin additive product.

Accordingly, a need exists for a process which provides efficient means for removal of the tarry reaction degradation byproduct material from the reaction product producing a substantially uncontaminated aminated sulfurized olefin in high yields.

The general object of this invention is to improve processes for the preparation of aminated sulfurized olefins commonly known as aminated trithiones. Another object of this invention is to produce a highly effective aminated sulfurized olefin. Another object of this invention is to improve the dispersancy properties of aminated sulfurized olefins. Further objects appear hereinafter.

I have discovered that the presence of an alkali metal or an alkaline earth metal compound in the reaction mixture promotes rapid and efficient separation of the tarry reaction degradation byproducts from the aminated sulfurized olefin compound during purification. Apparently, the alkali metal or alkaline earth metal compound reacts with or absorbs the tarry reaction byproducts and reduces the sticky, tacky characteristic of the material. The tarry-metal compound product then rapidly precipitates and can be easily removed by washing, filtration, or centrifugation. After the addition of the alkaline metal compound, the tarry material no longer coats and fouls reaction vessels and equipment and no longer causes impurities in finished product.

Alkali metal or alkaline earth metal compounds that can be used to promote the removal of tarry byproduct degradation products from olefin sulfur amine reaction include lithium oxide, sodium hydroxide, potassium chloride, calcium oxide, calcium hydroxide, magnesium oxide, magnesium hydroxide, calcium carbonate, barium carbonate, barium oxide, barium hydroxide, cesium chloride, etc. For reasons of ease of use, availability and low cost, calcium oxide or hydroxide and magnesium oxide or hydroxide are preferred.

Olefins useful in the preparation of the sulfurized aminated olefins of this invention comprise unsaturated hydrocarbons including mono- or polyunsaturated olefinic hydrocarbons recovered from refinery streams having 10 to 10,000 carbon atoms, polyolefins, etc. These olefins include tertiary octene, 2-decene, dodecene, eicosene, etc. Other olefins can be produced by the polymerization of low molecular weight olefin monomers. The polymerization of these olefins can be obtained by contacting an olefin or a mixture of olefins generally in liquid phase with a catalyst such as sulfuric acid, boron trifluoride, aluminum chloride, Ziegler-Natta or other similar catalysts well known in the art. Preferably, olefinic polymers can be derived from ethylene (ethene) and propene (propylene), 1-butene, 2-butene, isobutylene (2-methyl-propene), or nonconjugated or conjugated dienes such as butadiene or 5-ethylidene-2-norbornene, etc. Preferred substantially amorphous or viscous polyolefins include an ethylene-propylene copolymer, an ethylene-propylene-diene terpolymer, an ethylene-propylene-5-methylidene-2-norbornen polymer, an ethylene-propylene-5-ethylidene-2-norbornene polymer, polyisobutylene, poly-1-butene, etc., or mixtures thereof. These olefins have a molecular weight of from about 150 to about 140,000 or greater. Preferably, polymers having a molecular weight from about 300 to about 100,000 are useful for reasons of economy, reactivity, and availability.

Sulfur compounds useful for producing the aminated sulfurized olefins of this invention include solid, particulate, or molten forms of elemental sulfur or sulfur yielding compounds such as sulfur monochloride, sulfur dichloride, or other sulfur yielding compounds including hydrogen sulfide, phosphorus pentasulfide, etc. Fine particulate or molten elemental sulfur is preferred for reasons of ease of handling, high reactivity, availability, and low cost.

Amines useful in preparing the aminated sulfurized olefins for this invention include aliphatic amines and polyamines having a general formula $NH_2(CH_2)_yNH_2$ wherein y is an integer of 2 to 12; polyalkylene polyamines of the general formula $NH_2[(CH_2)_zNH]_xH$, wherein z is an integer from about 2 to 6 and x is an integer from about 1 to 10. Illustrative of suitable amines are methylamine, butylamine, cyclohexylamine, isopropylamine, decylamine, ethylenediamine, trimethylenediamine, tetramethylenediamine, hexamethylenediamine, ethylene diamine, diethylenetriamine, triethylenetetraamine, tetraethylenepentamine, tripropylenetetraamine, tetrapropylenepentamine or mixtures thereof, and other polyalkylene polyamines in which the alkylene group contains about 12 carbon atoms. Other useful polyamines are a bis(aminoalkyl)-piperazine, a bis(aminoalkyl)ethylene diamine, bis-(aminoalkyl)propylene diamine, N-amino-alkylmorpholene, 1,3-propanepolyamines, and polyoxy-polyamines.

In somewhat greater detail, the novel products of this invention can be produced by reacting an olefin, sulfur or sulfur yielding compound, and an amine in the presence of the alkali metal or alkaline earth metal compound. The reactants can be simultaneously reacted however, to afford reaction control and improved product, the following reaction sequence is preferred: (a) reacting the olefin in the sulfur or sulfur yielding compound to produce a sulfurized olefin; (b) reacting the sulfurized olefin with an amine to produce an aminated sulfurized olefin. The alkali metal or alkaline earth metal compound can be added at any time in the sequence of reactions, however the metal compound is conveniently added with the amine or prior to the amine addition and final filtration.

About 0.1–20 moles of sulfur or sulfur affording material can be reacted with the olefin per mole of olefin compound. Preferably, from about 2 to 8 moles of sulfur are reacted with the olefin per mole of olefin compound to provide essentially complete sulfurization. The temperature range of sulfurization reaction is general about 40°-400° C., preferably about 100°-250° C. The most preferred temperature range is about 150°-200° C. for reasons of rapid reaction rate and reduced decomposition of reactants. Frequently, the sulfurization reaction can be performed in the presence of sulfurization catalysts which are added to the reaction mixture to increase yield and rate of reaction. These catalysts include for example acidified clays, paratoluene sulfonic acid, dialkylphosphorodithioic acid, and a phosphorous sulfide compound.

The time required to complete the sulfurization will vary depending on ratios of reactants, reaction temperature, catalyst and purity of reagents. The course of reaction is conveniently monitored by following reaction vessel pressure or hydrogen sulfide evolution. The reaction can be considered complete when the reaction vessel pressure begins to decline or evolution of hydrogen sulfide begins to decline.

If desired, volatile materials can be removed by stripping the sulfurized olefin with an inert gas at an elevated temperature for a period of time so that substantially all volatile materials have been removed. The reaction product can also be filtered or centrifuged to remove all undesirable particulate matter at this time.

The sulfurized olefin can be reacted with from about 0.1-20 moles of amine per mole of sulfurized olefin. About 0.5-2 moles of amine per mole of olefin is used for reasons of high dispersancy and low cost of the resultant product. The amination reaction is commonly performed at temperatures between about 40°-400° C., preferably at temperatures of about 150°-200° C. for reasons of rapid reaction and low product degradation. While reaction time is variable depending on purity and concentration and ratio of reactants, the reaction commonly is complete is about 2-24 hours. Volatile and particulate matter can be conveniently removed after the amination reaction. For further details of production of the aminated sulfurized olefin see U.S. Pat. Nos. 3,459,664 and 3,364,232 which are expressly incorporated by reference herein.

The removal of the tarry byproduct can be promoted by the addition of effective amounts of alkali metal or alkaline earth metal compounds. About 0.1-20 parts of the alkali metal or alkaline earth metal compound can be added per 100 parts of the reaction mixture. Preferably about 1 to 10 parts of alkali metal or alkaline earth metal compound can be added per 100 parts of reaction mixture. The alkali metal or alkaline earth metal compound can be added at the time of the amination reaction. However, the best results apparently are obtained when the alkali metal or alkaline earth metal compound is added prior to or simultaneously with the amine compound.

The metal compound is conveniently added in a solution or suspension of the compound in a substantially inert liquid that can be conveniently removed during final product preparation. Water, lubricating oil, xylene, benzene, lingroin, etc. can be used to carry the compound. If necessary, the solution or suspension can be heated to improve its viscosity and handling characteristics.

The reactions detailed above can be performed in batch or continuous mode. In batch mode, the reactant or reactants and appropriate diluent are added to a suitable vessel for reaction. At the end of the reaction, the product is withdrawn to appropriate strippers, filters, centrifuges and other purification apparatus. In continuous mode, a stream of reactants is continuously combined at an appropriate rate and ratio in a vertical or horizontal reaction zone maintained at the reaction temperature. The reaction mixture stream is continually withdrawn from the reaction zone and is directed to appropriate strippers or purification apparatus.

The following examples and tables of data are illustrative of methods, equipment and materials used in preparing the aminated sulfurized olefin in the presence of the alkali metal or alkaline earth metal compounds. The examples and data should not be used to unduly limit the scope of the invention.

EXAMPLE I

Into a 1-liter, three-neck flask equipped with a nitrogen inlet tube, water trap, stirrer, and heater were charged 340 grams (0.16 moles) of polyisobutylene polymer having average molecular weight of about 2126, 26.0 grams (0.81 moles) of sulfur and 26 grams (0.14 moles) of tetraethylene pentamine and 200 grams 5 W oil. The mixture was heated and stirred to a temperature of 165° C. under an inert nitrogen blanket, and hydrogen sulfide evolution was measured. The reaction was continued for about 20 hours until hydrogen sulfide evolution indicated complete of reaction. At the end of this time, the mixture containing substantial amounts of black tarry char was mixed with celite and filtered with great difficulty. Substantial amounts of product was lost during filtration.

EXAMPLE II

Into a 2-liter resin kettle was charged 1544 grams (0.69 moles) of polyisobutylene (molecular weight 2246) and 110.13 grams (3.4 moles) sulfur. The mixture was stirred and heated to about 200° C. and held for 24 hours. During this time, about 46.7 liters (about 2.05 moles) of hydrogen sulfide was evolved indicating approximately complete reaction. At the end of this period, the mixture was stripped of volatile materials with nitrogen at 130° C. The product had a molecular weight of 2755. Into a 5-liter, 3-neck round bottom flask having a reflux condenser, nitrogen inlet tube, a stirrer, a heater and water trap was charged 1192 grams of the above sulfurized polyisobutylene, 44.5 grams (0.23 moles) tetraethylene pentamine, 75.49 grams (1.3 moles) magnesium hydroxide, 39.73 milliliters of water and 347.67 grams of 5 W oil and 400 milliliters of xylene. The mixture was stirred and heated to a temperature of 160° C. under a stream of nitrogen. Water and volatile material were removed. After 5 hours at 100° C., the temperature of the reaction was raised to 185° C. After 1 hour, 200 milliliters of celite were added and the batch was cooled to 120° C. 3.7 liters of heptane was added to the reaction mixture which filtered rapidly through celite. Volatile material was stripped at high temperature. The product contained 1.29 weight percent sulfur and 0.529 weight percent nitrogen.

Examples I and II show that the presence of the metal compound in the reaction mixture greatly facilitates filtering the product.

The foregoing specification is illustrative of the invention. Since many embodiments of this invention can be made, the invention resides solely in the claims hereinafter appended.

I claim:

1. In a process for producing an aminated sulfurized olefin composition which comprises reacting a substantially amorphous polyolefin, about 0.1 to 20.0 moles of sulfur or a sulfur-yielding compound per mole of polyolefin and about 0.01 to 20.0 moles of a polyamine per mole of polyolefin at a temperature of about 40° to 400° C., to produce an aminated sulfurized olefin contaminated with a tarry and charred reaction by-product, the improvement comprising reacting the polyolefin, sulfur or sulfur-yielding compound, and polyamine with about 1 to 10 parts of an alkaline earth metal compound per 100 parts of reaction mixture to absorb the tarry and charred reaction by-product forming a tarry-metal compound product and readily separating the tarry-metal compound product from the aminated sulfurized olefin.

2. The process of claim 1 wherein the alkaline earth metal compound is calcium oxide, calcium hydroxide, magnesium oxide or magnesium hydroxide.

3. The process of claim 1 wherein the substantially amorphous polyolefin is an ethylene-propylene copolymer, or an ethylene-propylene-diene terpolymer.

4. The process of claim 3 wherein the ethylene-propylene-diene terpolymer is ethylene-propylene-5-ethylidene-2-norbonene terpolymer or ethylene-propylene-5-methylidene-2-norbonene terpolymer.

5. The process of claim 1 wherein the polyamine is ethylenediamine, diethylene triamine, triethylenetetramine, tetraethylenepentamine, hexamethylenediamene or mixtures thereof.

* * * * *